US009103627B1

(12) United States Patent
Campbell

(10) Patent No.: US 9,103,627 B1
(45) Date of Patent: Aug. 11, 2015

(54) ASSEMBLY FOR HOLDING A CONCEALED HANDGUN BEHIND A HANDHELD ELECTRONIC DEVICE

(71) Applicant: Russell C. Campbell, Yardley, PA (US)

(72) Inventor: Russell C. Campbell, Yardley, PA (US)

( * ) Notice: Subject to any disclaimer, the term of this patent is extended or adjusted under 35 U.S.C. 154(b) by 43 days.

(21) Appl. No.: 14/033,432

(22) Filed: Sep. 20, 2013

(51) Int. Cl.
*F41C 33/02* (2006.01)
*F41C 33/00* (2006.01)

(52) U.S. Cl.
CPC ..... *F41C 33/02* (2013.01); *F41C 33/006* (2013.01); *F41C 33/0209* (2013.01)

(58) Field of Classification Search
USPC ..... 224/222, 223, 911, 912
See application file for complete search history.

(56) References Cited

U.S. PATENT DOCUMENTS 4,325,505 A * 4/1982 Hillman ..... 224/238
5,265,781 A * 11/1993 Nichols ..... 224/198
5,269,448 A * 12/1993 Shoemaker ..... 224/243
5,544,794 A * 8/1996 Nichols ..... 224/667
5,671,830 A * 9/1997 Wood ..... 190/101
5,704,529 A * 1/1998 Santoro et al. ..... 224/629
2002/0179653 A1* 12/2002 Klamm ..... 224/153
2004/0217141 A1* 11/2004 Brooks ..... 224/587
2005/0183913 A1* 8/2005 Godshaw et al. ..... 190/18 R
2006/0011680 A1* 1/2006 Cook et al. ..... 224/243
2006/0144885 A1* 7/2006 Smeuninx ..... 224/629
2007/0170219 A1* 7/2007 Ballarta et al. ..... 224/645
2007/0228091 A1* 10/2007 Shawen ..... 224/153
2008/0023513 A1* 1/2008 Hadj-Chikh ..... 224/645
2012/0205409 A1* 8/2012 Quartarone, III ..... 224/259
2013/0015225 A1 1/2013 Hogue
2014/0027479 A1* 1/2014 Hogue ..... 224/183

* cited by examiner

*Primary Examiner* — Brian D Nash
(74) *Attorney, Agent, or Firm* — LaMorte & Associates, P.C.

(57) ABSTRACT

An assembly for holding a concealed handgun behind a handheld electronic device in a carrier. A carry case is provided that has a front panel, a rear panel, and a middle panel. The front panel, middle panel and rear panel are oriented in parallel. The front panel contains at least one area that is transparent. A forward compartment is defined within the carry case between the front panel and the middle panel. The forward compartment is sized to receive and hold a handheld electronic device. A rearward compartment is defined within the carry case between the middle panel and the rear panel. A gun holster is connected to the carry case within the rearward compartment. The rearward compartment is behind the forward compartment and is large enough to surround the gun holster and a handgun set into the gun holster.

17 Claims, 6 Drawing Sheets

ASSEMBLY FOR HOLDING A CONCEALED HANDGUN BEHIND A HANDHELD ELECTRONIC DEVICE

BACKGROUND OF THE INVENTION

1. Field of the Invention

In general, the present invention relates to holsters for carrying a concealed handgun. More particularly, the present invention relates to holsters that are camouflaged as secondary objects.

2. Prior Art Description

Many people are licensed to carry concealed handguns. However, handguns are often too heavy, bulky, and dangerous to just be placed unprotected in a pocket. As such, most people who choose to carry a handgun elect to carry that handgun in a holster. The holster protects the handgun and retains the handgun in a position that enables the handgun to be quickly drawn when needed. The holster also prevents the trigger and safety of the handgun from being inadvertently contacted when the handgun is not needed.

There exist many types of holsters for handguns. Many holsters are designed to be worn in inconspicuous positions, such as under the arm, along a waist belt, or on the lower leg. This prevents the handgun from being seen by other people when carried. Likewise, holsters have been camouflaged as other objects so that even if they are seen, they are not recognized as being gun holsters. Holsters that are camouflaged as secondary objects are exemplified by U.S. Patent Application Pub. No. 2013/0015225 to Hogue, entitled Handgun Holster For Concealed Carry, which shows a gun holster camouflaged as a cellular telephone.

Although many different holsters exist for holding concealed handguns, such holsters do require that certain types of clothing be worn. For example, a holster that is worn on a waist belt requires that a person wear a waist belt. A holster that is worn under the arm requires that a person wear a jacket to cover the holster. If the proper clothing is not worn, the gun holster cannot be properly carried and/or concealed.

The most difficult time to carry a concealed gun holster is when a person is dressed for exercise. When exercising, a person typically wears a minimum of clothing. Furthermore, the clothing that is worn is usually lightweight and thin. For example, a typical person who jogs for exercise wears shorts and a light shirt. This provides very little space and structure to retain a concealed gun holster.

Fortunately, many people who exercise outdoors also like to carry some handheld electronic device, such as a cell phone or a digital music player. Such devices are often carried in small pouches that a person straps to his/her arm as they exercise. In this high position on the arm, the handheld electronic device can accommodate the wire leads of headphones without interfering with a person's ability to exercise vigorously.

The present invention is a novel assembly that combines a carrier for a handheld electronic device with a concealed holster, therein enabling a person dressed for exercise to comfortably carry both a concealed handgun and an electronic device. The details of the novel assembly are described and claimed below.

SUMMARY OF THE INVENTION

The present invention is an assembly for holding a concealed handgun behind a handheld electronic device in a carrier that appears only to hold the handheld electronic device.

A carry case is provided that has a front panel, a rear panel, and a middle panel that is interposed between the front panel and the rear panel. The front panel, middle panel and rear panel are oriented in parallel. The front panel contains at least one area that is transparent.

A forward compartment is defined within the carry case between the front panel and the middle panel. The forward compartment is sized to receive and hold a handheld electronic device. Once in the forward compartment, the handheld electronic device is visible through the transparent sections of the front panel.

A rearward compartment is defined within the carry case between the middle panel and the rear panel. A gun holster is connected to the carry case within the rearward compartment. The rearward compartment is behind the forward compartment and is large enough to surround the gun holster and a handgun set into the gun holster.

Access ports are provided for accessing the handheld electronic device in the forward compartment and the handgun and holster in the rearward compartment.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention assembly can be embodied in many ways, only two exemplary embodiments of the assembly are shown. The exemplary embodiments are selected in order to set forth two of the best modes contemplated for the invention. The illustrated embodiments, however, are merely exemplary and should not be considered a limitation when interpreting the scope of the appended claims.

Figure 1:
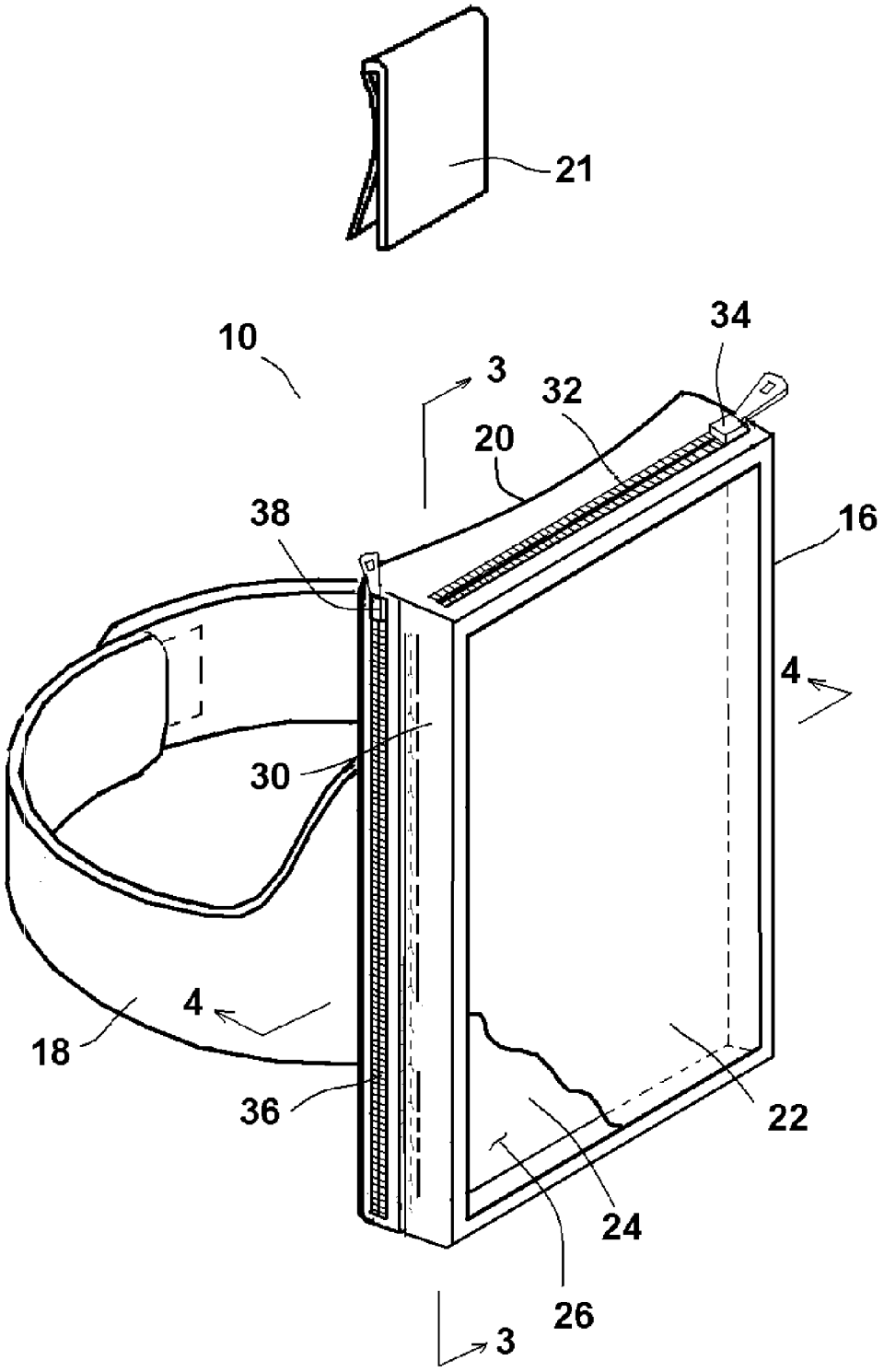
FIG. 1 is a perspective view of an exemplary embodiment of an assembly.
Figure 2:
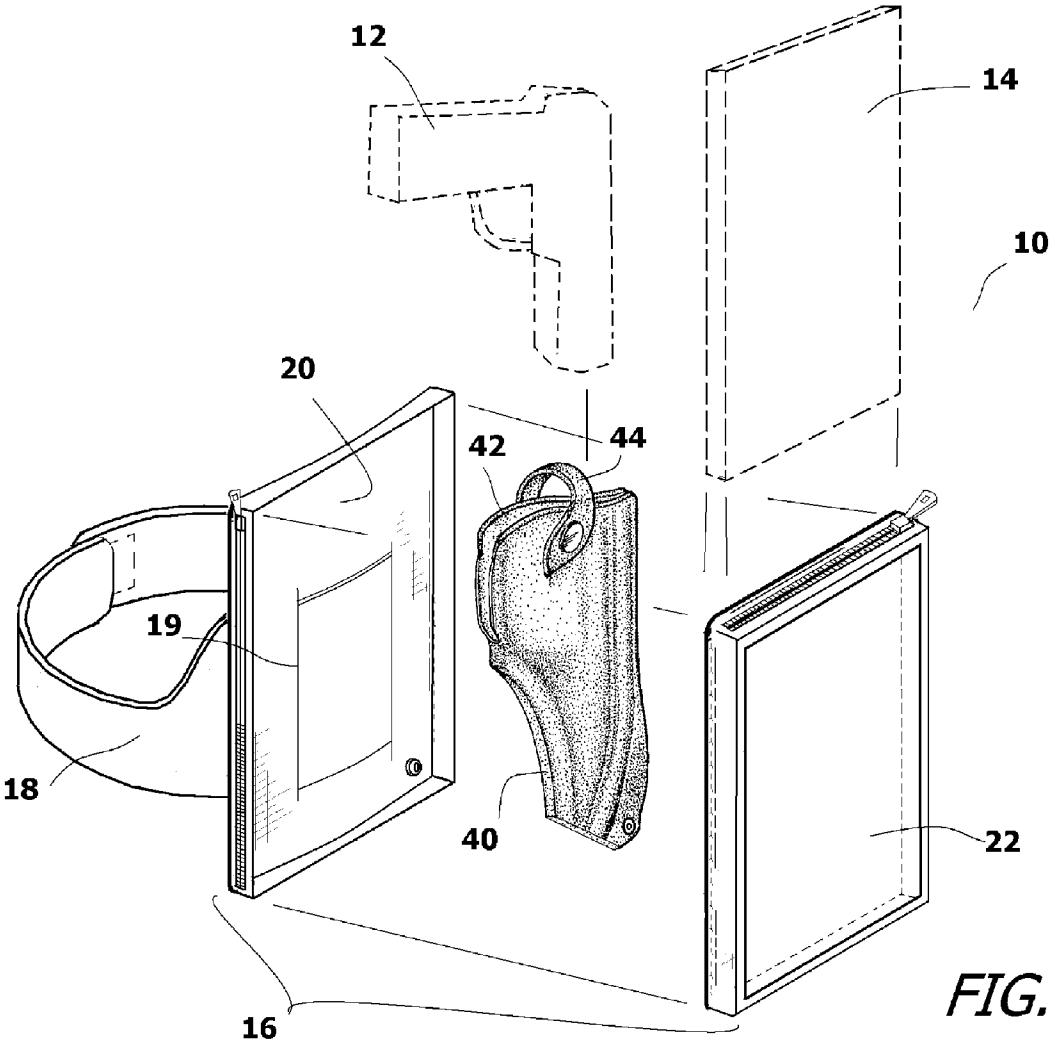
FIG. 2 is an exploded view of the exemplary embodiment of FIG. 1 shown in conjunction with a handgun and a handheld electronic device.
Figure 3:
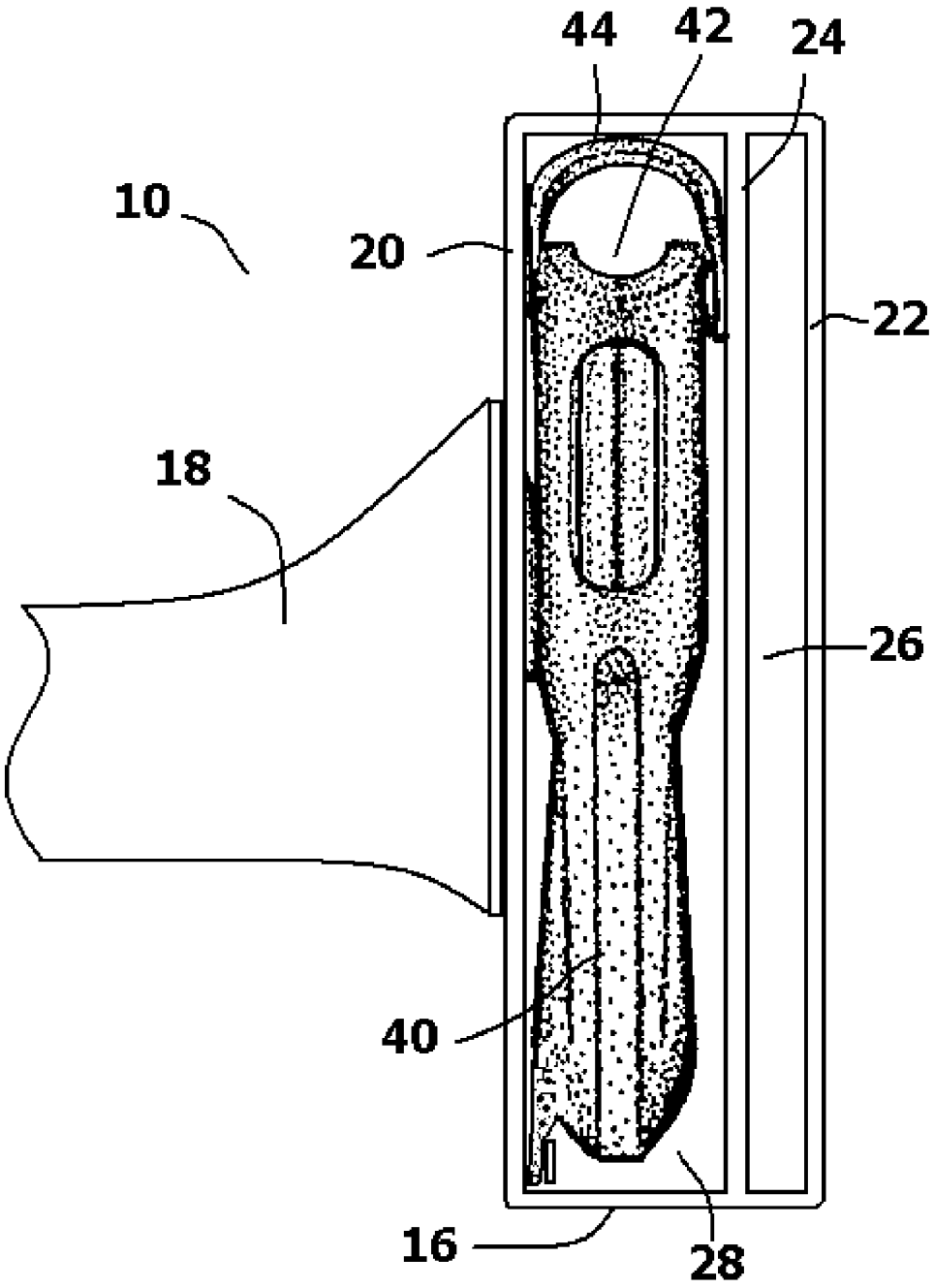
FIG. 3 is a cross-sectional view of the exemplary embodiment viewed along section line 3-3 in FIG. 1.

Referring to FIG. 1 in conjunction with both FIG. 2 and FIG. 3, an assembly 10 is shown that is designed to hold a handgun 12 in a concealed manner behind a handheld electronic device 14, such as a mobile telephone or an MP3 player. The assembly 10 includes a carry case 16. The carry case 16 defines two separate compartments, as will be later explained in more detail. The carry case 16 is optionally connected to a limb strap 18. The limb strap 18 enables the carry case 16 to be secured to a limb, such as a person's arm or leg.

The attachment of the carry case 16 to the limb strap 18 may be permanent. However, it is preferred that the attachment between the carry case 16 and the limb strap 18 be selective so that the carry case 16 can be removed from the limb strap 18. In the shown embodiment, a belt loop 19 is formed on the rear panel 20 of the carry case 16. The limb strap 18 passes through the belt loop 19, therein mechanically joining the carry case 16 to the limb strap 18. The use of a belt loop 19 is only exemplary. FIG. 1 also shows an optional belt clip 21. The limb strap 19 and be removed and the belt clip 21 attached if it is desired to carry the assembly along a user's waist.

Within the carry case 16 there are three parallel panels that define the front and back of two separate internal compartments. In the rear of the carry case 16 is the rear panel 20. The rear panel 20 is the part of the carry case 16 that attaches to the limb strap 18. The rear panel 20 also presses against the user's body. As such, the rear panel 20 can be fabricated to be slightly curved. This makes contact with the rear panel 20 more comfortable. In the front of the carry case 16, the carry case 16 has a front panel 22. Interposed between the front panel 22 and the rear panel 20 is a middle panel 24. The rear panel 20, middle panel 24 and front panel 22 are generally the same size and are oriented in parallel planes.

Within the carry case 16, a forward compartment 26 is defined between the front panel 22 and the middle panel 24. Furthermore, a rearward compartment 28 is defined between the middle panel 24 and the rear panel 20. Edge panels 30 interconnect the peripheries of the rear panel 20, middle panel 24 and front panel 22 to complete the carry case 16 with its separate forward compartment 26 and rearward compartment 28.

The forward compartment 26 is designed to receive and retain a handheld electronic device 14, such as a mobile phone, MP3 player, or palm computer. Such handheld electronic devices are typically less than 0.5 inches thick. Accordingly, the distance between the front panel 22 and the middle panel 24 in the forward compartment 26 is preferably less than 0.5 inches. In this manner, the handheld electronic device 14 is held snuggly within the forward compartment 26 and remains relatively stationary once placed within the forward compartment 26.

The forward compartment 26 is defined between the front panel 22 and the middle panel 24. At least part of the front panel 22 is made from a clear flexible plastic. In this manner, the interior of the forward compartment 26 can be viewed through the front panel 22.

A first access opening 32 is formed in at least one of the edge panels 30 that define the forward compartment 26. The first access opening 32 can be selectively opened and closed by a mechanical closure 34. In the shown embodiment, the mechanical closure 34 is a zipper. However, closures, such as hook and loop closures and snap closures can also be used. The access opening 32 enables a handheld electronic device 14 to be placed within the forward compartment 26. Once within the forward compartment 26, the mechanical closure 34 is used to close the first access opening 32 and isolate the handheld electronic device 14 within the forward compartment 26. The handheld electronic device 14 can be viewed through the transparent sections of the front panel 22. Furthermore, the handheld electronic device 14 can be touched and operated by pressing the front panel 22 against the handheld electronic device 14.

Since the forward compartment 26 is the more forward of the two compartments in the carry case 16, any handheld electronic device 14 placed in the forward compartment 26 will be visible through the transparent sections of the front panel 22 as the assembly 10 is worn on an arm or leg.

The rearward compartment 28 is defined between the middle panel 24 and the rear panel 20 of the carry case 16. The rearward compartment 28 is positioned directly behind the forward compartment 26. The rearward compartment 28 has the same height and length as the forward compartment 26. However, the rearward compartment 26 is deeper than the forward compartment 26 so it can hold objects thicker than can the forward compartment 26. The distance between the middle panel 24 and the rear panel 20 in the rearward compartment 28 is preferably between one inch and two inches. This makes the rearward compartment 28 at least twice as deep as the forward compartment 26.

As has been previously described, the rearward compartment 28 is disposed between the middle panel 24 and the rear panel 20. The middle panel 24, the rear panel 20 and the joining edge panels 30 are all opaque. As such, the interior of the rearward compartment 28 cannot be viewed through the front panel 22 of the forward compartment 26 or from any external viewpoint. Although the rearward compartment 28 and the forward compartment 26 are distinct within the carry case 16, both compartments 26, 28 are defined by the same edge panels 30. Consequently, when viewed from any external point, the carry case 16 appears to contain only a single internal compartment.

A second access opening 36 is provided in the carry case 16 that provides access to the rearward compartment 28. The second access opening 36 preferably contains a zipper or similar mechanical closure 38 that enables the second access opening 36 to be selectively opened and closed.

A gun holster 40 is provided that is sized to hold a compact handgun 12. The dimensions and the volume of the rearward compartment 28 enable the rearward compartment 28 to receive and retain both the handgun 12 and the gun holster 40 within its periphery. The gun holster 40 has an open end 42 that enables the handgun 12 to be inserted into the gun holster 40. The gun holster 40 also contains a retention strap 44 that holds the handgun 12 securely within the gun holster 40 and prevents the handgun 12 from inadvertently falling out of the gun holster 40. The gun holster 40 may be made from the same fabric as the carry case 16. However, it is preferred that the gun holster 40 be made of a thicker material, such as leather, so as to better protect the handgun 12 and prevent the metal edges of the handgun 12 from wearing through the gun holster 40.

The gun holster 40 may be sewn into place within the rearward compartment 28. However, it is preferred that the gun holster 40 and the carry case 16 be separate and distinct structures. The gun holster 40 is preferably removable from the rearward compartment 28. In this manner, the handgun 12 need not be removed from the gun holster 40 in order to remove the handgun 12 from the carry case 16.

The gun holster 40 is provided with a connector that joins the gun holster 40 to the interior of the rearward compartment 28. The preferred connector is a snap connector 46, however, other connector types can be used. The benefit of a snap connector 46 is twofold. First, a snap connector 46 enables the gun holster 40 to be quickly connected to, or disconnected from, a snap base 48 set into the interior of the rearward compartment 28. Second, a snap connector 46 creates a pivot connection with the snap base 48. That is, a snap connector 46 can rotate about the snap base 48. This enables the gun holster 40 to rotate about the snap base 48 while the snap connector 46 retains a mechanical interconnection with the snap base 48.

Figure 4:
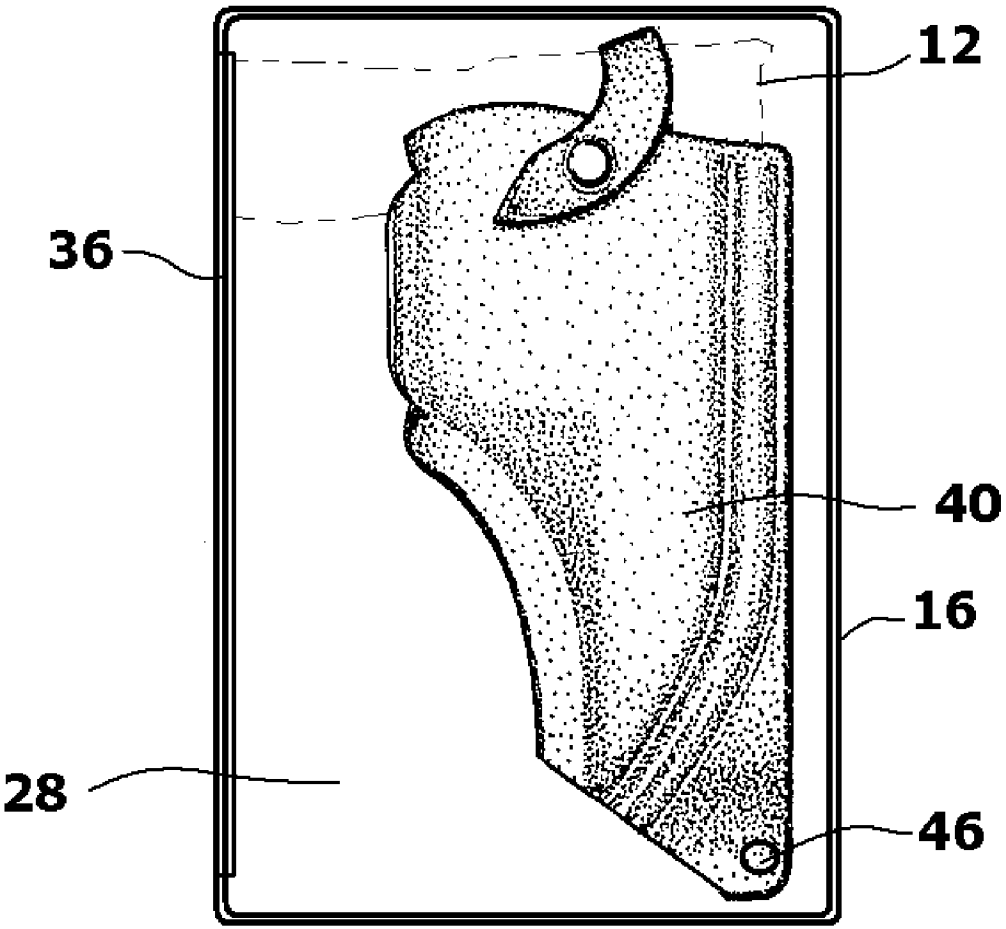
FIG. 4 is a cross-sectional view of the exemplary embodiment viewed along section line 4-4 in FIG. 1.
Figure 5:
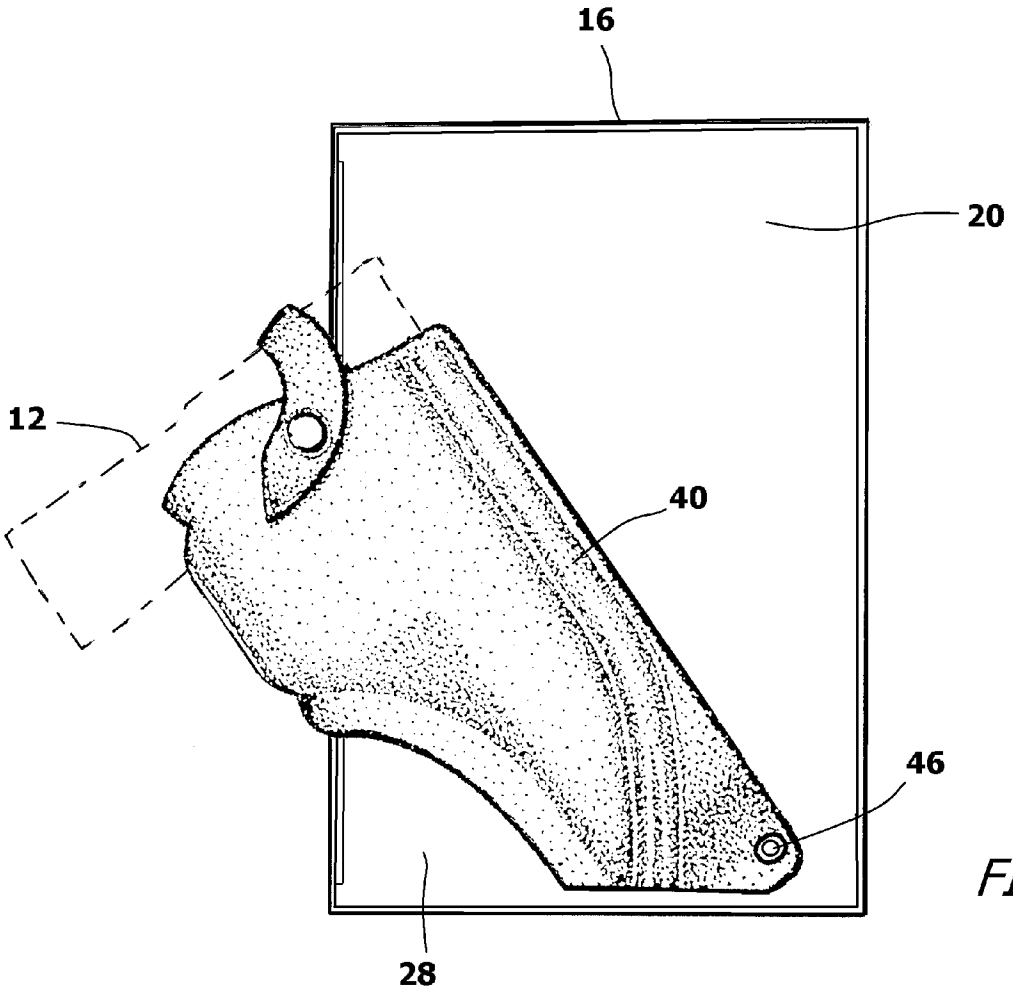
FIG. 5 is the same view as FIG. 4 with the holster shown in a rotated orientation.

Referring now to FIG. 4 in conjunction with FIG. 5, it can be seen that the snap connector 46 enables the gun holster 40 to rotate from a first position (FIG. 4) to a second position (FIG. 5). In the first position, the entire gun holster 40 and the handgun 12 it holds are contained within the confines of the rearward compartment 28 of the carry case 16. In the second position, the part of the holster 40 protrudes out of the rearward compartment 28 through the second access opening 36.

The ability of the gun holster 40 to rotate in position enables the handgun 12 it holds to be better grasped and removed from the gun holster 40 when the carry case 16 is mounted to a person's arm or leg.

In FIG. 3 and FIG. 4, the snap connector 46 of the gun holster 40 can connect to only one snap base 50 that is mounted to the rear panel 20 of the rearward compartment 28. It will be understood that the assembly 10 can be worn low on a person's leg or high on a person's arm. Also, the assembly 10 may be used by a right-handed person or a left-handed person. As such, it may be desirable to provide the rearward compartment 28 with access openings on either side of the compartment. It also may be desirable to reverse the orientation of the gun holster 40 and handgun within the rearward compartment 28.

Figure 6:
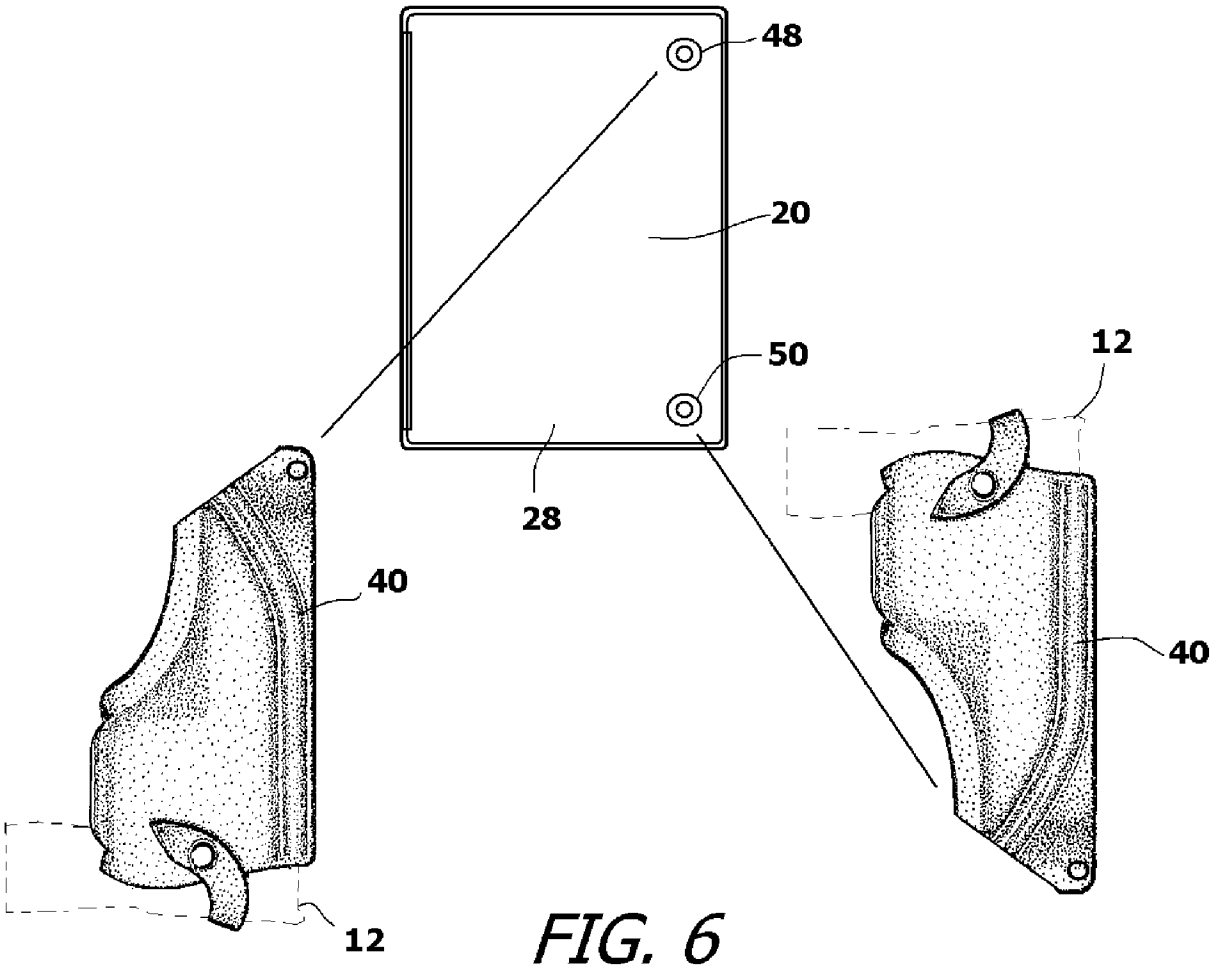
FIG. 6 shows an alternate embodiment of the rear panel within the rearward compartment.

Referring to FIG. 6, such an alternate embodiment of the rear panel 20 in the rearward compartment 28 is shown. In this embodiment, multiple snap bases 48, 50 are provided. The multiple snap bases 48, 50 enable the gun holster 40 and the handgun 12 to be attached to the carry case 16 in either an upward orientation or a downward orientation. The position of the gun holster 40 and handgun 12 can be decided by the requirements of the user.

It will be understood that the embodiments of the present invention that are illustrated and described are merely exemplary and that a person skilled in the art can make many variations to those embodiments. For instance, the shape of the holster can be determined by the model of the handgun being retained. The shape of the holster and the size of the carry case can be altered to accommodate handguns of different models. All such embodiments are intended to be included within the scope of the present invention as defined by the claims.

What is claimed is:

1. An assembly for holding both a handgun and a handheld electronic device; said assembly comprising:

a carry case having a periphery defined by edge panels, said carry case having a front panel, a rear panel and a middle panel interposed between said front panel and said rear panel, wherein front panel, said rear panel, and said middle panel all connect to each of said edge panels;

wherein said front panel contains at least one area that is transparent;

wherein said front panel, said middle panel and said rear panel are parallel, wherein a forward compartment is defined within said carry case within said edge panels between said front panel and said middle panel, and wherein a rearward compartment is defined within said carry case within said edge panels between said middle panel and said rear panel, said forward compartment and said rearward compartment having a common length and a common height;

a gun holster connected to said carry case, within said rearward compartment, with a connector, wherein said gun holster is free to rotate about said connector relative to said carry case;

a first access opening in said carry case that provides access to said forward compartment; and a second access opening in said carry case that provides access to said rearward compartment.

2. The assembly according to claim 1, wherein said rearward compartment contains a plurality of points to which said connector on said gun holster can attach.

3. The assembly according to claim 1, wherein said connector is a snap connector that joins said gun holster to said rear panel.

4. The assembly according to claim 1, wherein said gun holster is free to rotate about said connector from a first position within said rearward compartment to a second position partially extending out of said rearward compartment through said second access opening.

5. The assembly according to claim 1, further including a limb strap attached to said rear panel of said carry case.

6. The assembly according to claim 5, further including an attachment mechanism disposed between said limb strap and said rear panel that enables said carry case to be selectively detached from said limb strap.

7. The assembly according to claim 1, wherein said gun holster includes a gun retention strap for locking a handgun within said gun holster.

8. The assembly according to claim 1, wherein said front panel and said middle panel are separated by a distance of no greater than 0.5 inches in said forward compartment.

9. The assembly according to claim 1, wherein said middle panel and said rear panel are separated by a distance of no greater than two inches in said rearward compartment.

10. An assembly for holding both a handgun and a handheld electronic device, said assembly comprising:

a carry case having a front panel, a rear panel and a middle panel interposed therebetween, wherein said front panel, said middle panel and said rear panel are affixed in parallel within a common set of edge panels, wherein a forward compartment is defined between said front panel and said middle panel, and a rearward compartment is defined between said middle panel and said rear panel, and wherein said forward compartment and said rearward compartment have a common length and width;

an access opening disposed along said common set of edge panels, wherein said access opening leads to said rearward compartment;

a gun holster connected to said carry case with a pivot connection within said rearward compartment, wherein said gun holster is free to rotate about said pivot connection from a first position inside said rearward compartment through said access opening to a second position partially extending outside of said rearward compartment.

11. The assembly according to claim 10, wherein said front panel contains a plastic window that is transparent.

12. The assembly according to claim 10, further including a limb strap attached to said carry case for attaching said carry case to a limb of a person.

13. The assembly according to claim 12, further including an attachment mechanism disposed between said limb strap and said rear panel that enables said carry case to be selectively detached from said limb strap.

14. The assembly according to claim 10, wherein said gun holster includes a gun retention strap for locking a handgun within said gun holster.

15. The assembly according to claim 10, wherein said front panel and said middle panel are separated by a distance of no greater than 0.5 inches in said forward compartment.

16. The assembly according to claim 10, wherein said middle panel and said rear panel are separated by a distance of no greater than two inches in said rearward compartment.

17. An assembly for holding both a handgun and a handheld electronic device; said assembly comprising:

a carry case having a front panel, a rear panel and a middle panel interposed between said front panel and said rear panel, wherein said front panel contains at least one area that is transparent;

wherein said front panel, said middle panel and said rear panel are parallel, wherein a forward compartment is defined within said carry case between said front panel and said middle panel, and wherein a rearward compartment is defined within said carry case between said middle panel and said rear panel;

a gun holster connected to said carry case within said rearward compartment;

a first access opening in said carry case that provides access to said forward compartment;

a second access opening in said carry case that provides access to said rearward compartment;

a limb strap attached to said rear panel of said carry case; and an attachment mechanism disposed between said limb strap and said rear panel that enables said carry case to be selectively detached from said limb strap.

* * * * *